United States Patent [19]

Helding et al.

[11] 4,331,354

[45] May 25, 1982

[54] DOOR PUSH BAR LOCK-OUT RETAINER

[76] Inventors: Curtis L. Helding, 2803 Fleetwood Dr.; Carl R. Larrabee, 4234 Wood Rd., both of Racine, Wis. 53403

[21] Appl. No.: 159,834

[22] Filed: Jun. 16, 1980

[51] Int. Cl.[3] ..... E05C 15/02

[52] U.S. Cl. ..... 292/92

[58] Field of Search ..... 292/92, 109, 114, 108, 292/153, 210, 21

[56] References Cited

U.S. PATENT DOCUMENTS

| | | | |
|---|---|---|---|
| 1,067,241 | 7/1913 | Foss . | |
| 1,079,603 | 11/1913 | Marty . | |
| 1,357,007 | 10/1920 | Smith . | |
| 2,212,957 | 8/1940 | Spradling . | |
| 2,295,360 | 9/1942 | Schneider | 292/114 |
| 2,783,071 | 2/1957 | Williams | 292/109 |
| 2,836,451 | 5/1958 | Clifton, Jr. . | |
| 2,910,857 | 11/1959 | Muessel | 70/92 |
| 2,932,536 | 4/1960 | Pyknen | 292/21 |
| 3,148,903 | 9/1964 | Foster | 292/1 |
| 3,722,938 | 3/1973 | Bauer et al. | 292/92 |
| 3,819,213 | 6/1974 | Vanderburgh | 292/21 |
| 3,993,335 | 11/1976 | Schmidt | 292/21 |

FOREIGN PATENT DOCUMENTS

| | | | |
|---|---|---|---|
| 9877 | of 1905 | United Kingdom | 292/114 |

*Primary Examiner*—Richard E. Moore

*Attorney, Agent, or Firm*—Arthur J. Hansmann

[57] ABSTRACT

A door push bar lock-out retainer for a door having a swingable push bar. A member is swingably attachable to the door and can swing above the level of the push bar and then downwardly thereon and it has a hook for retaining the push bar in the unlocked position. A pin and an elongate slot form an attachment for the member so that it can swing above the push bar even when the push bar is in its unlocked position away from the door.

4 Claims, 4 Drawing Figures

DOOR PUSH BAR LOCK-OUT RETAINER

This invention relates to a door push bar lock-out retainer which is effective for holding the standard push bar toward the door and in its unlocked position as selectively desired by the user.

BACKGROUND OF THE INVENTION

The prior art is already aware of the concerns and of some of the solutions for holding a door push bar in an unlocked position so that the door can be opened from the outside. However, those prior art devices are extremely complicated and some are not even applicable for being installed on already existing standard doors with push bars. Additionally, the prior art devices are extremely complicated in the number of parts required and in the association of the lock-out device or its members relative to a push bar type of door. Examples of some of the prior art are shown in U.S. Pat. Nos. 1,067,241 and 1,079,603 and 1,357,007 and 2,212,957 and 2,836,451 and 2,910,857 and 2,932,536 and 3,148,903 and 3,819,213 and 3,993,335. The aforementioned patents are different from the structure shown in the present invention in that those patents are of a complicated structure requiring many parts, that is more than three parts which are all that are required in the present invention. Further, at least many, if not all, of those disclosures are not adaptable for easy inclusion in an already existing door of the push bar or panic bar type. To further distinguish over those patents, the present invention provides a three-piece assembleage which includes a hook which can be swung above the level of the push bar and which can then engage the push bar and retain it in its unlocked position. Further, the hook of this invention can be easily released from the locked position on the push bar so that the standard door can be returned to its normal functioning mode.

Accordingly, it is an object of this invention to provide a reliable and simplified type of retainer for a push bar type of door, and wherein the retainer of this invention can be readily adapted to an already existing push bar type of door. Further, the present invention accomplishes its objectives while requiring only three-pieces, namely, a mounting piece, a latch piece, and an interconnecting pin for the two pieces.

Another object of this invention is to provide a simplified type of retainer for a push bar type of door, and wherein the retainer will not inadvertantly move to the operative or securing position and it will be readily apparent by visual observation that the retainer of this invention is in the inoperative position, all so that the door will not be inadvertantly left in the unsecured or unlocked mode.

Other objects and advantages will become apparent upon reading the following description in light of the accompanying drawings.

DETAILED DESCRIPTION OF THE PREFERRED EMBODIMENT

Figure 1:
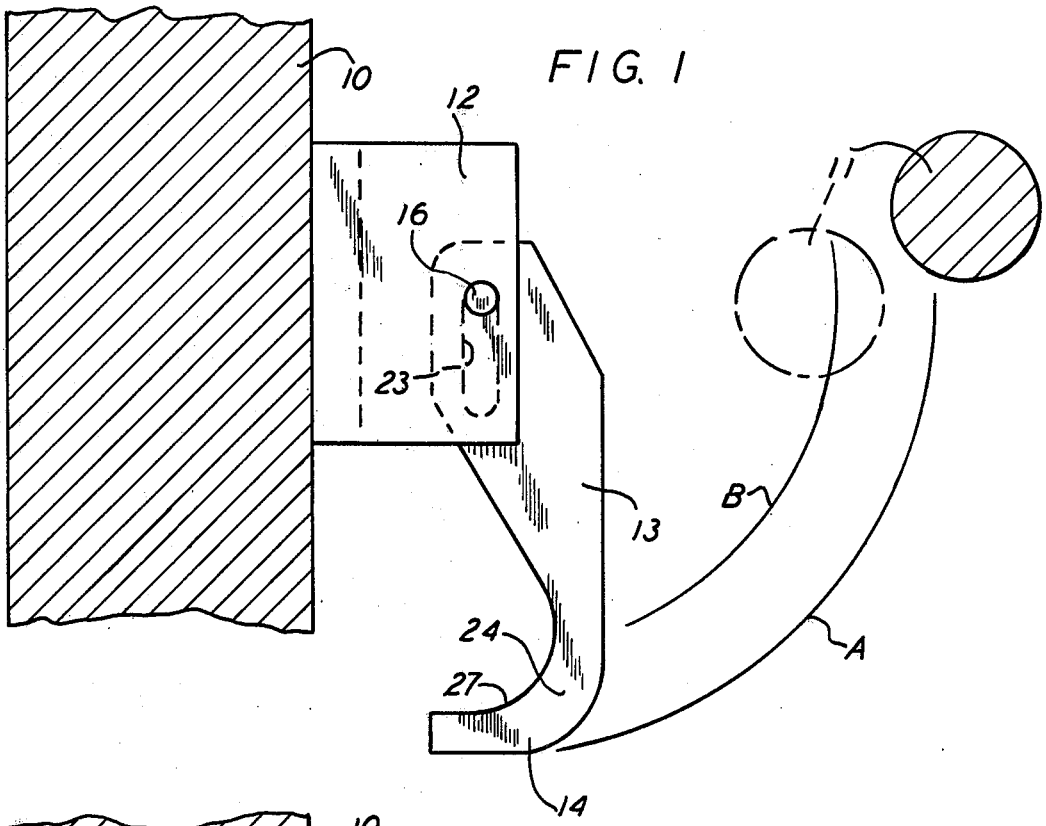
FIG. 1 is a side elevational view of a preferred embodiment of this invention and showing two positions for the door push bar.

The drawings show a representation of a standard building door 10 having its usual push bar 11 which is suitably swingably mounted on the door 10 to move from the solid line position in FIG. 1 and to the dot-dash line position shown, and that movement would be toward the door 10 and to the unlocked position. That is, as would be readily understood, the door has the usual latch which is controlled by a push bar 11, and the door of course is secured in the latched or locked position through the operation of the push bar 11. That is, the aforesaid prior art patents show the standard arrangement of a building door with a swingable push bar for latching and unlatching the door from the inside of the building, all in a conventional arrangement.

FIG. 1 shows the three-piece retainer of this invention, and it shows it in the unlatched or inoperative position. The retainer includes a mounting bracket 12, a member 13 which has its extending end including a hook 14, and the retainer includes a mounting pin 16 which interconnects the bracket 12 and the member 13. Thus, the member 13 is pivotal or swingable relative to the door 10 and the attachment means which includes the mounting bracket 12. Further, FIG. 3 shows that the mounting bracket 12 is U-shaped and has two legs 17 and a central open portion 18. The member 13 is of a straight configuration, as viewed in FIG. 3, and it has its opposite sides 19 parallel to each other and spaced apart a width comparable to the width of the bracket opening 18. Thus the member 13 is snugly disposed in the bracket 12 and has its sides 19 bearing against the inner walls 21 defining the opening 18, and thus the member 13 is laterally stable in the direction transverse to the direction of pivot or swinging movement of the member 18, such as shown between the down position of FIG. 1 and the up and operative position of FIG. 2.

The mounting bracket 12 can be secured to the door by any conventional means, and four screws can be used, such as the shown two screws 22 extending along the mounting bracket legs 17 and into the door 10 in FIG. 3. The pivot or mounting pin 16 then extends through the bracket legs 17 and through an elongate slot 23 in the member 13, and thus the member 13 can swing or pivot on the mounting pin 16. Further, the member 13 can move radially relative to the longitudinal axis of the mounting pin 16, and that would be by means of sliding the member 13 on the pin 16 through use of the slot 23.

In that regard, FIG. 1 shows an arc designated A which extends from the outer most portion of the member 13 and into the solid line position of the push bar 11. That means that the member 13 could not swing above the push bar 11, except for the provision of the attachment means of the pin 16 and the elongate slot 23 which permits a retraction of the member 13 so that it can swing up past the push bar 11 and then be lowered on to the push bar 11 in the operative or latched position shown in FIG. 2. Also in that FIG. 2 position it will be noted that the member 13 is in its radially outer limit or extent so that it thus holds the push bar 11 in the dot-dash position shown in FIG. 1 and that is the door unlocked position, as desired.

Figure 2:
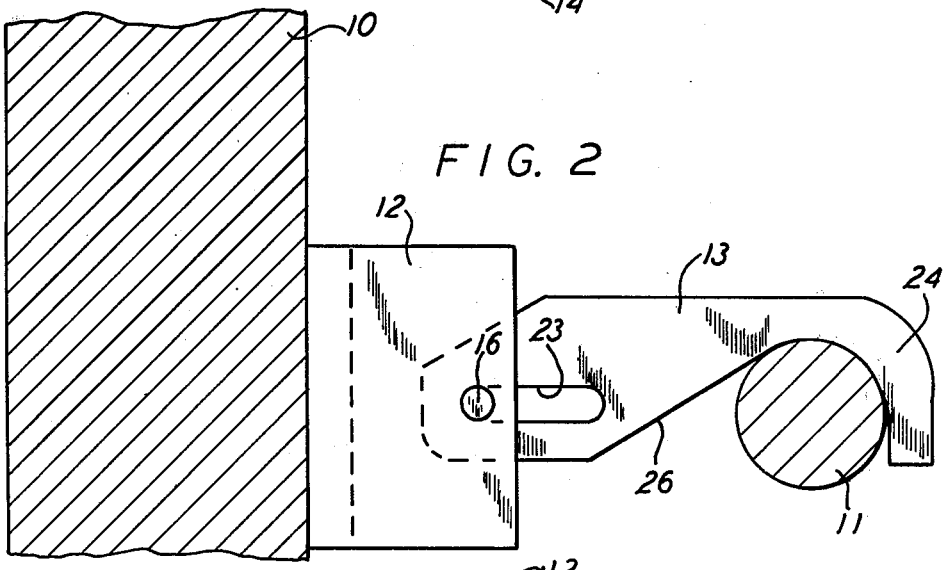
FIG. 2 is a side elevational view of the showing in FIG. 1, but with the retainer of this invention in the operative position.
Figure 4:
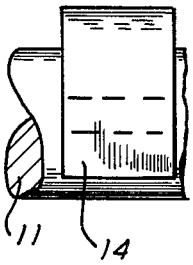
FIG. 4 is a right side elevational view of FIG. 2.
Figure 3:
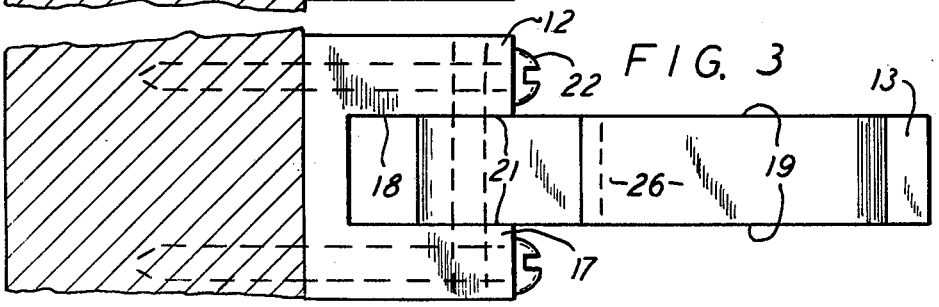
FIG. 3 is a bottom plan view of FIG. 2.

Further, the extending end of the member 13, that is the hook 14, has the arcuate surface 24 which is of a curvature to conform to the circular configuration of the push bar 11 and thus to be secure and snug with the push bar 11 in the FIG. 2 position since at least a quarter section of the outer circumference of the push bar 11 is shown to be in contact with the arcuate surface 24 which therefore extends through that quarter arc mentioned. In that position, it will be seen and understood that the hook 14 is downwardly facing to thus rest downwardly and thus securely on the push bar 11 in the FIG. 2 position. Further, the arrangement of the retainer having only those three pieces is such that it is definite and secure in the inoperative position of FIG. 1 in that it is simply hanging downwardly and completely clear of the push bar 11 so it will not inadvertantly be latched with the push bar 11.

Thus, in using the retainer of this invention, the operator can simply move the member 11 radially inwardly relative to the pin 16 and swing it above the push bar 11. Next, the push bar 11 can be moved to the dot-dash line position of FIG. 1 and then the raised member 13 can be lowered down onto the push bar 11 to the position shown in FIG. 2. In that position, the door will be in the unlocked mode and one can open it from either the inside or the outside and the push bar need not be used or moved for that opening procedure.

Subsequently, when the retainer is to be placed in the unused position, then the member 13 is swung upwardly off the push bar 11 which is then allowed to go to its full line position in FIG. 1, and the member 13 is moved inwardly toward the door as it is slid with its slot moving over the pin 16, and the member 13 can then clear the push bar 11 and be swung downwardly to its inoperative position of FIG. 1.

In this invention, there is provided a retainer which requires only three pieces, namely, the mounting bracket 12, the member 13, and the mounting pin 16. Those three pieces can be readily and easily mounted on an existing push bar type of door, and they are also reliable and simple to maneuver in the manners mentioned above. Still further, the retainer of this invention readily reveals to anyone who looks at it that it is either in the inoperative position of FIG. 1 or in the operative position of FIG. 2, and there are no parts concealed inside the door or elsewhere which need be inspected to determine what mode the retainer may be in.

The member 13 thus has an extended position, as shown in FIG. 2, and it also has a retracted position where it is moved inwardly toward the door 10 when the slot 23 is slid over the pin 16. The length of the member 13 from the axis of the pin 16 is greater than the distance from the pin 16 to the position of the push bar 11 in full lines in FIG. 1, and that position is the normal locked position for the door. Finally, the length of the member 13 from the axis of the pin 16 in the retracted position is less than that distance from the pin 16 to the push bar 11 in the unlocked position of the latter and, the arc B shown in FIG. 1 indicates the pivotal swinging extremity of the member 13 when the member 13 is in that retracted position so that the hook 14 clears the undepressed bar 11.

Still another aspect is that when the member 13 is in the operative position of FIG. 2, if one pushes the push bar 11 toward the door 10, in the usual form of opening the door 10, the member 13 would simply have its underneath surface 26 slide over the upper surface of the push bar 11 to accommodate any inward movement of the push bar 11. However, the member 13 would again assume its operative or latched position of FIG. 2 once the force on push bar 11 is released. In that manner, the member 13 can not be inadvertantly released simply by having one use the push bar 11 without intending to actually release the member 13. The under-surface 26 is thus tangential to the arcuate hook surface 27 which defines the hook 24, and the arc 27 is of a radius the same as that of the push bar 11 so that the hook 24 is snug with the push bar 11, in the FIG. 2 position.

What is claimed is:

1. A door push bar lock-out retainer, comprising a hingedly mounted door having a push bar swingably mounted on said door and spaced from said door and extending horizontally and being movable for swinging toward and away from said door and being in a door-unlocked position when swung in toward said door, a member swingably attached by means to said door on a horizontal pivot axis and including an extending end having a downwardly facing hook, said member being shaped and of a length sufficient to engage the side of said bar faced away from said door to thereby engage and secure said push bar inwardly towards said door in the push bar swung-in door-unlocked position, and said means attaching said door and said member having a slot which extends in the direction of the length of said member and is of a length sufficient to retract said hook toward said door to allow said hook to be swung past and clear of said push bar and thereabove and for subsequently positioning said hook downwardly onto said push bar in the push bar secured position.

2. The door push bar lock-out retainer as claimed in claim 1, wherein said means includes a mounting bracket mounted on said door for swingably attaching said member to said door, and a pin receiving said slot and being interconnected between said mounting bracket and said member for the swingable mounting of said member.

3. The door push bar lock-out retainer as claimed in claim 2, wherein said mounting bracket is U-shaped and has spaced apart legs, the opposite sides of said member being in contact with said legs of the U-shape of said mounting bracket and said member extends beyond said bracket, for lateral stability of said member in the direction transverse to the plane of swinging of said member.

4. The door push bar lock-out retainer as claimed in claim 2, wherein said slot is of a length to have said extending end of said member pivotal upwardly past and clear of said push bar when said push bar is in its locked position away from said door.

* * * * *